US008935873B2

(12) United States Patent
Moretti

(10) Patent No.: US 8,935,873 B2
(45) Date of Patent: Jan. 20, 2015

(54) BARREL ASSEMBLY FOR FIREARMS AND METHOD FOR MANUFACTURING IT

(75) Inventor: Luigi Moretti, Brescia (IT)

(73) Assignee: Benelli Armi S.p.A., Pessaro Urbino (IT)

( * ) Notice: Subject to any disclaimer, the term of this patent is extended or adjusted under 35 U.S.C. 154(b) by 0 days.

(21) Appl. No.: 13/534,270

(22) Filed: Jun. 27, 2012

(65) Prior Publication Data

US 2013/0174462 A1 Jul. 11, 2013

(30) Foreign Application Priority Data

Jun. 29, 2011 (IT) ..... MI2011A1184

(51) Int. Cl.

| | |
|---|---|
| ***F41C 7/11*** | (2006.01) |
| ***F41A 21/00*** | (2006.01) |
| ***F41A 21/08*** | (2006.01) |
| ***F41A 21/48*** | (2006.01) |

(52) U.S. Cl.

CPC ..... *F41A 21/00* (2013.01); *F41A 21/08* (2013.01); *F41A 21/48* (2013.01)

USPC ..... 42/76.1; 42/40; 89/14.8

(58) Field of Classification Search

CPC ..... F41C 7/11; F41A 3/58; F41A 3/60; F41A 15/06; F41A 21/00; F41A 21/06; F41A 21/08; F41A 9/34; F41F 1/08; C21D 9/10; B21C 37/152

USPC ..... 42/46, 75.01, 75.02, 76.01, 76.02, 76.1, 42/77, 40; 89/14.7, 14.8

See application file for complete search history.

(56) References Cited

U.S. PATENT DOCUMENTS

| | | | | |
|---|---|---|---|---|
| 3,984,933 | A * | 10/1976 | Ruger | 42/47 |
| 4,519,156 | A * | 5/1985 | Shaw | 42/77 |
| 8,296,987 | B1 * | 10/2012 | Dlubak et al. | 42/75.01 |
| 2004/0020092 | A1 * | 2/2004 | Christensen | 42/49.01 |
| 2005/0235546 | A1 | 10/2005 | Wonisch et al. | |
| 2006/0207154 | A1 | 9/2006 | Lazor | |
| 2012/0180625 | A1 * | 7/2012 | Gazayerli | 89/14.7 |

FOREIGN PATENT DOCUMENTS

| | | |
|---|---|---|
| EP | 0 822 382 A2 | 2/1988 |
| GB | 2 410 787 | 8/2005 |
| RU | 2235261 | 8/2004 |
| RU | 2293277 | 2/2007 |

* cited by examiner

*Primary Examiner* — Bret Hayes
*Assistant Examiner* — Joshua Freeman
(74) *Attorney, Agent, or Firm* — R. Neil Sudol; Henry D. Coleman

(57) ABSTRACT

A barrel assembly for firearms including one or more tubes associated with a mono-block, characterized in that the mono-block has one or more cylindrical protrusions which allow the connection of one or more of the tubes and the subsequent joining thereof by welding, adhesive bonding, forcing, etcetera. The method for manufacturing the barrel assembly is characterized in that it includes the steps of: providing a mono-block which includes one or more front cylindrical protrusions, one or more partial chambers axially aligned with the protrusions, and corresponding collars for the cartridge seats, extractor seats, and closure members such as closure tenons or other members; all the members are completed with their final dimensions; performing an overall heat treatment of the mono-block and of the barrels; connecting the tubes, which constitute the barrels of the firearm, by welding, adhesive bonding, forcing, etcetera, to the protrusions.

14 Claims, 4 Drawing Sheets

BARREL ASSEMBLY FOR FIREARMS AND METHOD FOR MANUFACTURING IT

BACKGROUND OF THE INVENTION

The present invention refers to a barrel assembly for firearms and to a method for manufacturing it.

As is known, multi-barreled shotguns, such as for example over-and-under or side-by-side shotguns for hunting and target shooting, have barrels which are mutually joined at the breech by means of the so-called demi-block, or chopper-lump, system, or by means of a mono-block.

In the demi-block system, two separate tubes of a set of barrels are joined together, where the right-hand half of the pair of lumps under the barrels are forged integrally with the right barrel and the left-hand half of the pair of lumps under the barrels are forged integrally with the left barrel.

In the mono-block system the entire breech end of both barrels and the lumps together are machined from one solid piece of steel. The barrel tubes are then fitted separately into a mono-block and the ribs attached.

In order to fix the tubes to the mono-block, each tube has a shank which is inserted in a respective cylindrical seat formed inside the mono-block, which of course has two superimposed seats.

The assembly constituted by the mono-block, the tubes and the ribs form the double barrel of the shotgun.

The extractors are mounted on the assembly and the finishing work, which consists in providing the cartridge chambers with the corresponding rims, is performed.

The assembly subsequently undergoes stress relieving in a furnace because of to the need to weld the ribs and any other components.

Subsequent reworking is therefore necessary and includes the localized heat treatment of the regions of the sleeve that are most intensely stressed during firing.

Some regions of the sleeve, however, are not treated adequately and can have a lower than desired strength, for example in the chamber seats, in the extractor seats, and in the extractor head seats, where these devices will be inserted.

With use, the seats become worn and after some time it is necessary to recondition the weapon; this work can be performed only by specialized personnel capable of performing the necessary machining of the seats that accommodate the new mechanisms or devices.

US-A-2006/0207154 discloses a multi-barreled shotgun barrel assembly construction constituted by a muzzle block, an extended chopper block, and barrel tubes, that join the two blocks. While the barrel tube manufacturing is simplified, such barrel construction introduces a further component, the muzzle block, that requires a precise working. Also, the extended chopper block requires the same type of working of a conventional chopper block.

OBJECTS OF THE INVENTION

The aim of the present invention is to provide a barrel assembly for firearms, and a method for manufacturing it which are conceptually new and are capable of overcoming the drawbacks of the cited prior art.

Within the scope of this aim, an object of the invention is to provide an assembly that can be manufactured more simply than traditional assemblies.

A further object of the invention is to provide an assembly that gives greater assurances of safety in use.

Still a further object is to provide an assembly capable of reducing costs and simplifying the operations for maintenance and replacement of the components.

SUMMARY OF THE INVENTION

This aim and these and other objects which will become better apparent hereinafter are achieved by a barrel assembly for firearms, comprising one or more tubes associated with a mono-block, characterized in that said mono-block comprises one or more cylindrical protrusions which allow the connection of one or more of said tubes and the subsequent joining thereof by welding, adhesive bonding, forcing, etcetera.

This aim and other objects which will become better apparent hereinafter are also achieved by a method for manufacturing a barrel assembly for firearms, characterized in that it comprises the steps of:

- providing a mono-block which comprises one or more front cylindrical protrusions, one or more partial chambers axially aligned with said protrusions, and corresponding collars for the cartridge seats, extractor seats and closure members such as closure tenons or other members; all the members are completed with the final dimensions;
- performing an overall heat treatment of the block;
- connecting one or more tubes, which constitute the barrel or barrels of the firearm, by welding, adhesive bonding, forcing, etcetera, to said one or more protrusions.

BRIEF DESCRIPTION OF THE DRAWINGS

Further characteristics and advantages will become better apparent from the description of preferred but not exclusive embodiments of the invention, illustrated by way of non-limiting example in the accompanying drawings, wherein.

DETAILED DESCRIPTION

Figure 1:
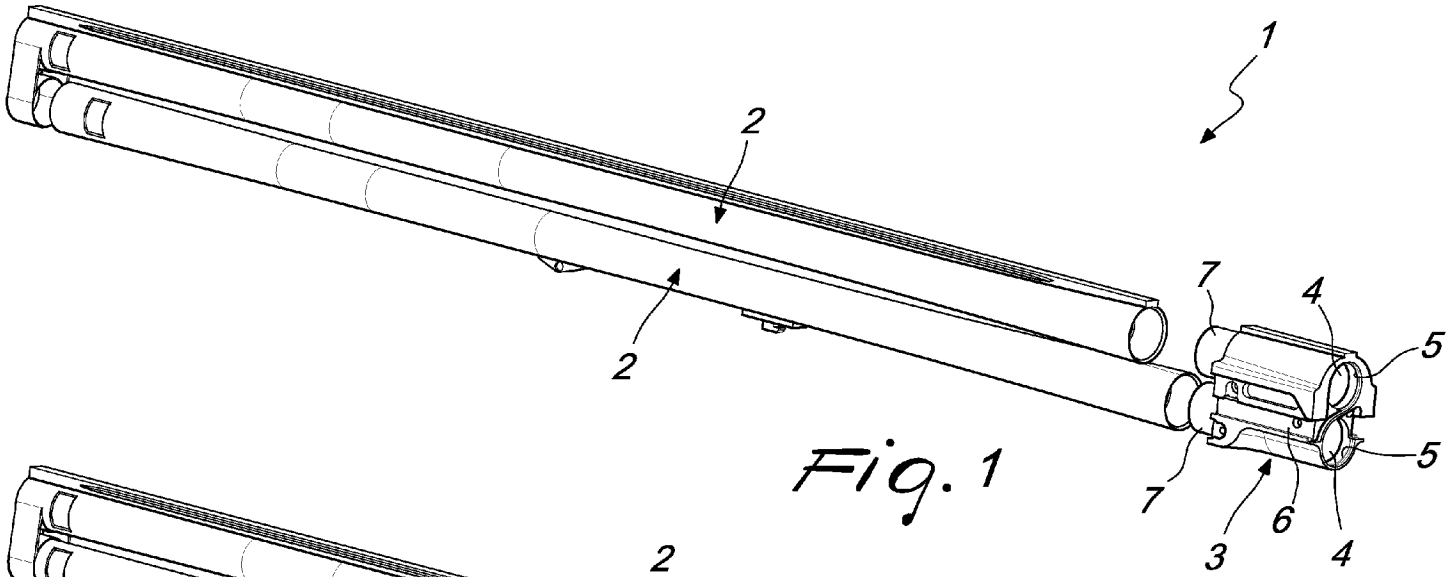
FIG. 1 is a partially exploded perspective view of a multi-barrel assembly according to the present invention.
Figure 2:
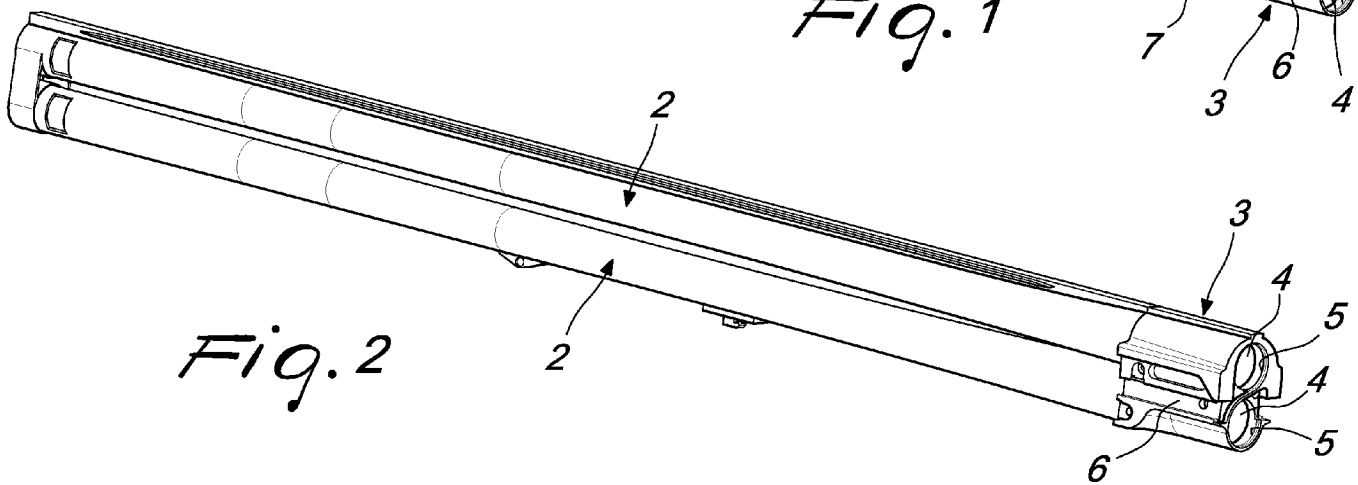
FIG. 2 is a perspective view of the multi-barrel assembly in the assembled condition.

With reference to the cited figures, the barrel assembly for firearms, according to the invention, generally designated by the reference numeral 1, comprises one or more tubes 2 associated with a mono-block 3.

The example illustrated herein refers to an assembly for an over-and-under shotgun, but it is evident to the person skilled in the art that the assembly and the method according to the present invention can be applied to any type of firearm with one or more barrels.

According to the invention, the mono-block 3 is provided monolithically by casting and/or machined from a billet, in order to obtain the final shape of the part.

The mono-block 3 can also be replaced by a block made of multiple parts.

The mono-block 3 is machined in order to form two partial chambers, designated by the reference numeral 4, and corresponding rims 5, for the cartridge seats, with the final dimensions.

The mono-block 3 is also machined to form seats 6 for the extractors, not shown in the figures, with the final dimensions, so as to ensure the complete interchangeability of the extractors.

The mono-block 3 is also machined to form closure tenons, or other closure members, with their final dimensions.

Figure 3:
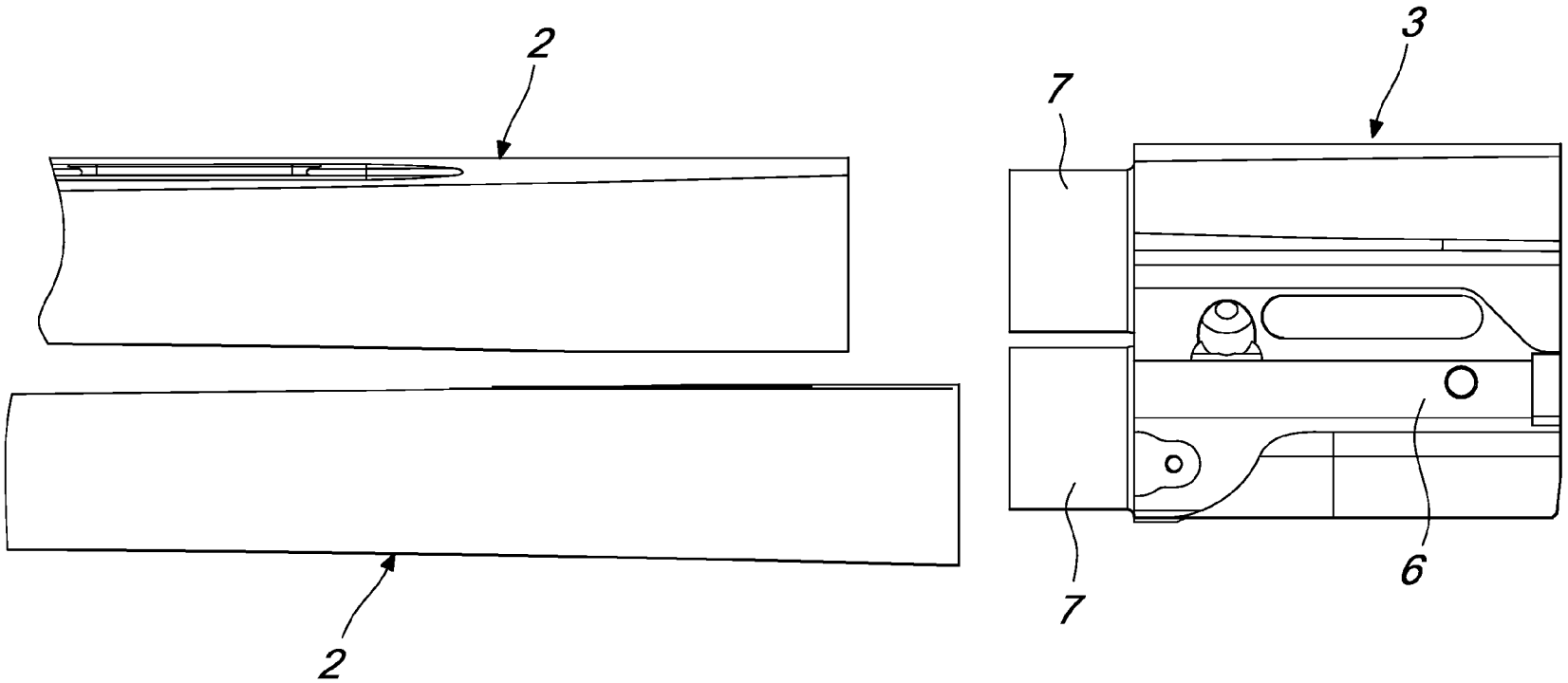
FIG. 3 is a partially exploded side view of the region of connection of the tubes to the mono-block.
Figure 4:
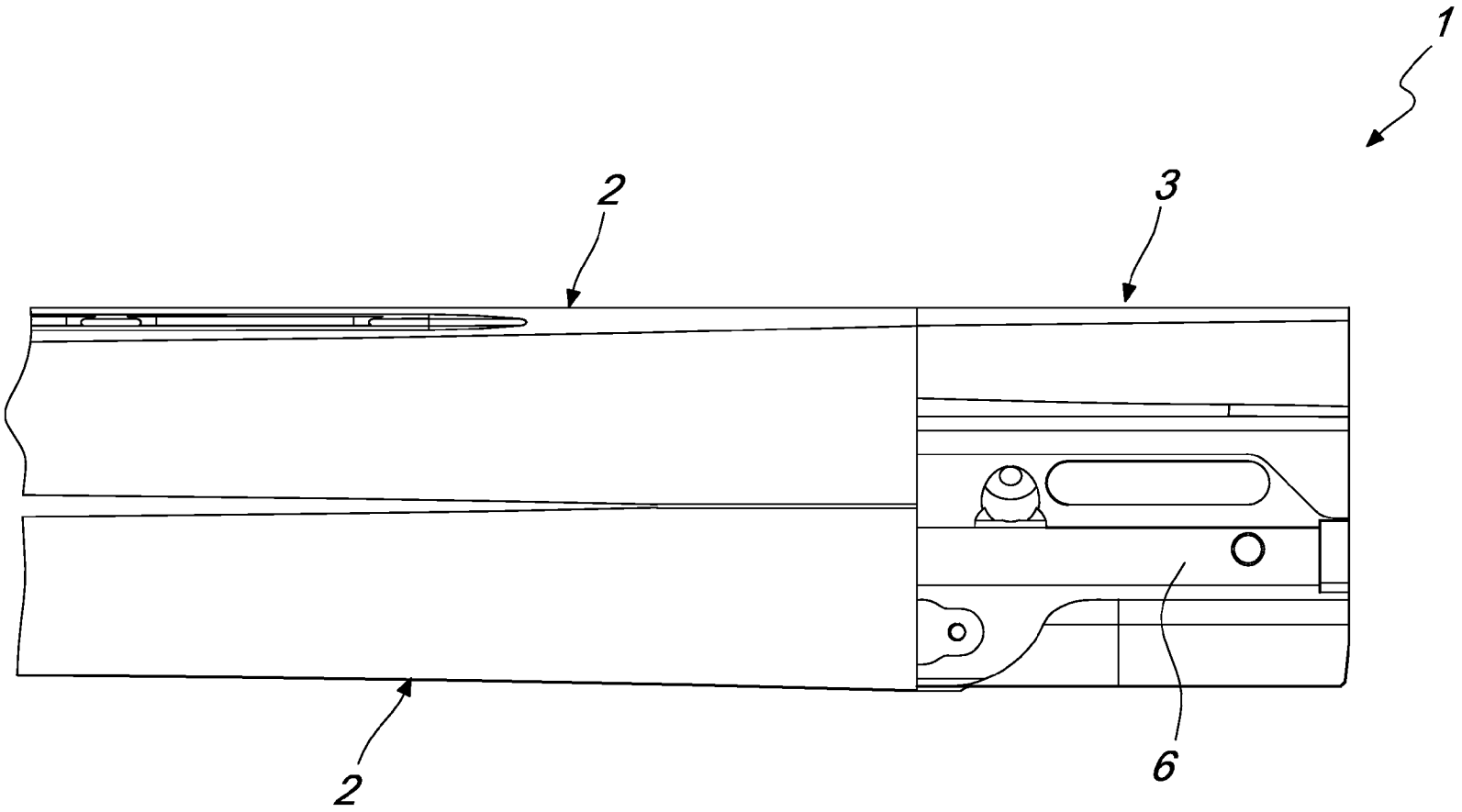
FIG. 4 is a side view of the region of connection of the tubes to the mono-block, in the assembled condition.
Figure 5:
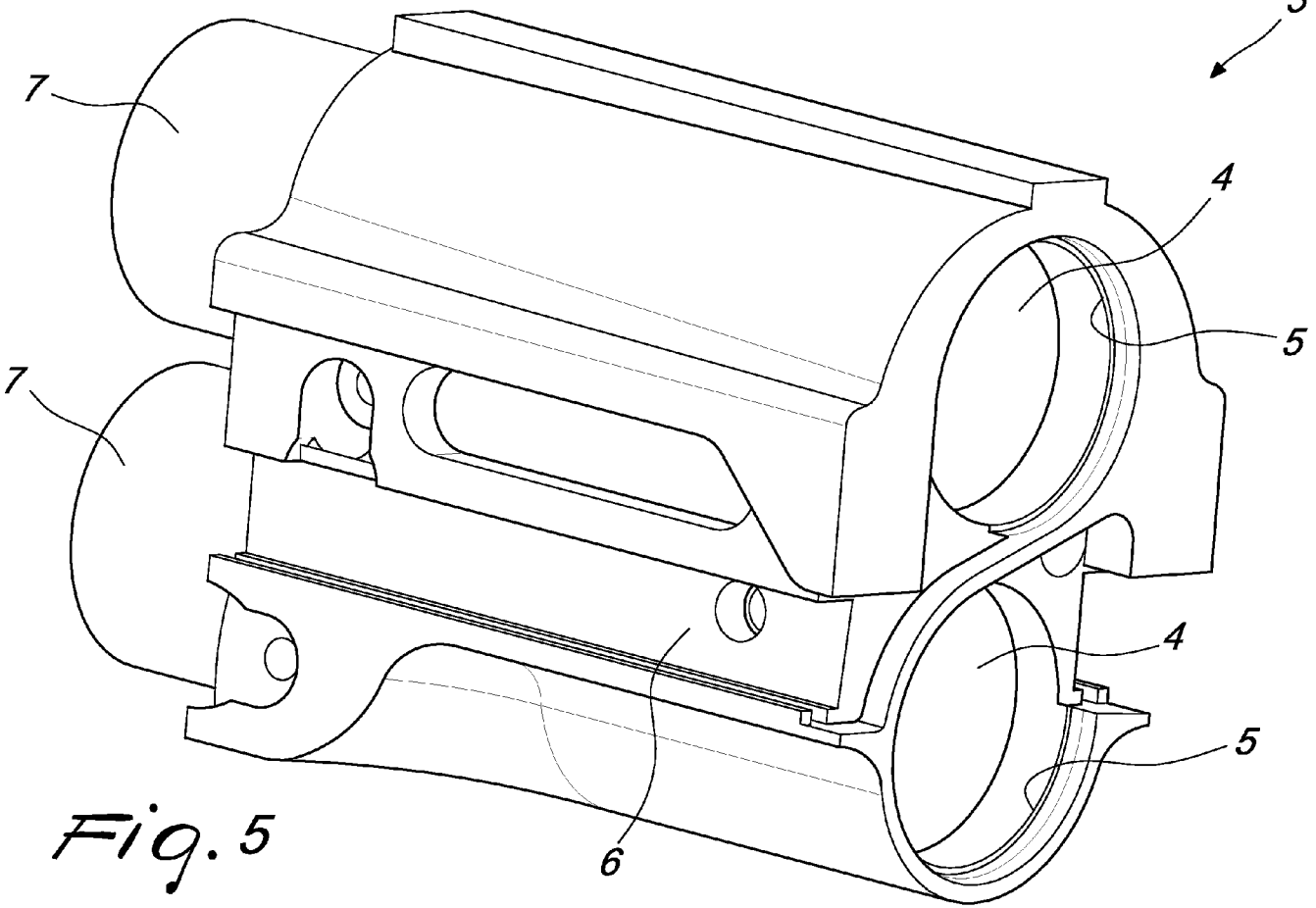
FIG. 5 is a perspective view of the mono-block.

At the front, the mono-block 3 has two cylindrical protrusions 7, which allow the insertion of the tubes 2 and their subsequent joining by welding, adhesive bonding, forcing, etcetera. As shown in FIG. 1, 3, and 5, each protrusion 7 has an axial length, in a firing direction, substantially smaller than an axial length of mono-block 3 as measured in the firing direction. Protrusions 7 are each disposed directly adjacent and contiguous with mono-block 3, without an intervening barrel section, so that joints formed between the tubes 2 and the mono-block 3 are directly adjacent and outside of the partial chambers 4.

According to the present invention, the mono-block 3 is completely thermally treated before assembling the barrels thereon.

The overall heat treatment ensures that the mono-block has the required mechanical characteristics both from a functional point of view and from a safety point of view.

The heat treatment is in fact performed on the entire block after all the machinings, with particular reference to the chambers, the rims and the extractor seats.

In this manner the interchangeability of the extractors and any other mechanisms installed subsequently is ensured.

In a conventional multi-barrel assembly it is not possible to replace the extractors and the other accessories without proceeding with new reconditioning working of the guides, of the rims, etc.

According to the prior art, the assembly would subsequently undergo stress relieving in a furnace, because of the welding, and the material would lose part of its mechanical characteristics; vice versa, according to the present invention, the characteristics acquired with the heat treatment of the mono-block and of the barrels are maintained, giving the present assembly higher mechanical characteristics than conventional assemblies, with a consequent improved safety, in case of accidental events such as obstructions or defects of the material.

On the contrary, in a conventional assembly, in which the mono-block can be subjected only to localized heat treatments, any defects of the material in untreated regions may cause severe drawbacks and failures.

Another advantage of the present assembly is that the processes are facilitated because they are concentrated on the sleeve and it is not necessary to perform high-precision work on the barrels.

In the assembly according to the present invention, the firing chamber is partially included inside the sleeve and involves the barrel only for the cone for connection to the bore of the barrel.

This fact is a considerable technical advantage because the welding surface is smaller.

In the present assembly, the portion of the chamber provided in the sleeve has a greater radial strength than that of a conventional assembly.

An important advantage of the present invention is that, since the passage in a traditional furnace is no longer necessary, the stress relieving of the barrels and of the mono-block is avoided.

Another advantage of the present assembly resides in that the operation for assembling the barrels on the mono-block is easier than the insertion thereof in a mono-block of the traditional type.

This is due to the fact that, according to the present invention, it is not necessary to perform the operations for grinding the shank of each barrel on the mono-block.

In practice it has been found that the invention achieves the intended aim and objects.

This application claims the priority of Italian Patent Application No. MI2011A001184, filed on Jun. 29, 2011, the subject matter of which is incorporated herein by reference.

The invention claimed is:

1. A barrel assembly for firearms, comprising one or more tubes associated with a mono-block, wherein said mono-block comprises at least one partial chamber and one or more cylindrical protrusions which allow connection of one or more of said tubes and subsequent joining thereof to said mono-block, said protrusions each having a free end spaced, in a firing direction, a distance from said mono-block substantially smaller than an axial length of said mono-block as measured in the firing direction, at least one joint between said one or more of said tubes and said mono-block being formed directly adjacent said at least one partial chamber.

2. A method for manufacturing a barrel assembly for firearms, comprising:

providing a mono-block which comprises one or more front cylindrical protrusions, one or more partial chambers axially aligned with said protrusions, and corresponding collars for said chambers, extractor seats and closure members such as closure tenons or other members; all said members being completed with final dimensions and not requiring subsequent machining, said protrusions each having a free end spaced, in a firing direction, a distance from said mono-block substantially smaller than an axial length of said mono-block as measured in the firing direction;

performing an overall heat treatment of the mono-block;

after performing said overall heat treatment, connecting one or more tubes, which constitute the barrel or barrels of the firearm, to said one or more protrusions to thereby form at least one joint between said one or more tubes and said mono-block directly adjacent said at least one or more partial chambers.

3. The method according to claim 2, wherein said mono-block is provided monolithically by casting.

4. The method according to claim 2, wherein said mono-block is provided monolithically by machining from a billet.

5. The method according to claim 2, wherein said mono-block is provided monolithically by casting and machining from a billet.

6. The method according to claim 2, wherein said mono-block is provided starting from multiple mutually joined parts.

7. The method according to claim 2, wherein the connecting of one or more tubes to said one or more protrusions includes a joining taken from the group consisting of welding, adhesive bonding, and forcing.

8. A barrel assembly for firearms, comprising one or more tubes associated with a mono-block, wherein said mono-block comprises at least one partial chamber and one or more cylindrical protrusions which allow connection of one or more of said tubes and subsequent joining thereof to said mono-block, said protrusions each being disposed directly adjacent and contiguous with said mono-block, without an intervening barrel section, at least one joint between said one or more of said tubes and said mono-block being formed directly adjacent and outside of said at least one partial chamber.

9. A method for manufacturing a barrel assembly for firearms, comprising:

providing a mono-block which comprises one or more front cylindrical protrusions, one or more partial chambers axially aligned with said protrusions, and corresponding collars for said chambers, extractor seats and closure members such as closure tenons or other members; all said members being completed with final dimensions and not requiring subsequent machining, said protrusions each being disposed directly adjacent and contiguous with said mono-block, without an intervening barrel section;

performing an overall heat treatment of the mono-block;

after performing said overall heat treatment, connecting one or more tubes, which constitute the barrel or barrels of the firearm, to said one or more protrusions to thereby form at least one joint between said one or more tubes and said mono-block directly adiacent and outside of said at least one or more partial chambers.

10. The method according to claim 9, wherein said mono-block is provided monolithically by casting.

11. The method according to claim 9, wherein said mono-block is provided monolithically by machining from a billet.

12. The method according to claim 9, wherein said mono-block is provided monolithically by casting and machining from a billet.

13. The method according to claim 9, wherein said mono-block is provided starting from multiple mutually joined parts.

14. The method according to claim 9, wherein the connecting of one or more tubes to said one or more protrusions includes a joining taken from the group consisting of welding, adhesive bonding, and forcing.

* * * * *